US008935837B2

(12) United States Patent
Jairala, Jr.

(10) Patent No.: US 8,935,837 B2
(45) Date of Patent: Jan. 20, 2015

(54) HANGING MEMORIAL

(71) Applicant: Boris Jairala, Jr., Brooklyn, NY (US)

(72) Inventor: Boris Jairala, Jr., Brooklyn, NY (US)

( * ) Notice: Subject to any disclaimer, the term of this patent is extended or adjusted under 35 U.S.C. 154(b) by 0 days.

(21) Appl. No.: 14/143,950

(22) Filed: Dec. 30, 2013

(65) Prior Publication Data

US 2014/0182096 A1 Jul. 3, 2014

Related U.S. Application Data

(60) Provisional application No. 61/746,721, filed on Dec. 28, 2012.

(51) Int. Cl.
*A61G 17/00* (2006.01)
*A61G 99/00* (2006.01)

(52) U.S. Cl.
CPC ..... *A61G 17/00* (2013.01); *A61G 99/00* (2013.01)
USPC ..... 27/1; 40/124.5; 40/722; 40/725

(58) Field of Classification Search
USPC ..... 27/1, 2, 10, 19; 40/124.5, 722–725, 40/798, 757; 211/85.27
See application file for complete search history.

(56) References Cited

U.S. PATENT DOCUMENTS 6,082,029 A * 7/2000 Hoffman ..... 40/124.06
6,349,494 B1 * 2/2002 Haggarty-Robbins ..... 40/723
6,735,831 B1 * 5/2004 Greiwe et al. ..... 27/1
6,826,863 B1 * 12/2004 Goodfellow ..... 40/725
6,883,212 B2 * 4/2005 Groemminger et al. ..... 27/10
7,082,653 B1 * 8/2006 Sueppel ..... 27/1
7,117,570 B1 * 10/2006 Borgerding ..... 27/1
7,191,499 B2 * 3/2007 Davis et al. ..... 27/1
7,373,703 B1 * 5/2008 Grenci ..... 27/1
7,562,423 B2 * 7/2009 Pryd-Kakuk ..... 27/1
7,934,299 B2 * 5/2011 Holzman ..... 27/27
8,046,881 B2 * 11/2011 Johnson et al. ..... 27/1
8,365,448 B2 * 2/2013 Gorham, Jr. ..... 40/124.5
8,510,921 B2 * 8/2013 Florea ..... 27/19
8,707,526 B2 * 4/2014 Cooke et al. ..... 27/1
2005/0144821 A1 * 7/2005 Griesemer et al. ..... 40/546
2009/0030804 A1 * 1/2009 Sell ..... 705/26
2010/0012606 A1 * 1/2010 Bourgo ..... 211/85.27
2012/0180275 A1 * 7/2012 Kocir ..... 27/1

* cited by examiner

*Primary Examiner* — William Miller

(57) ABSTRACT

A hanging memorial for displaying pictures and ashes of the deceased, and storing keepsakes. The hanging memorial includes a frame and an urn; the urn being integrated into the frame. A lateral wall and a front panel of the frame define a storage volume in which keepsakes can be placed. Alternatively an internal storage box can define the storage volume. The frame further includes a frame insert that can be configured to display a physical painting or photograph, or configured to display digital pictures. The urn is removably attached or pivotally connected to the frame by an at least one bracket, such that the contents of the urn are readily accessible. The hanging memorial may further include a niche about which the at least one bracket is positioned and into which the urn is positioned. Alternative support mechanism may also be used in place of the at least one bracket.

19 Claims, 21 Drawing Sheets

HANGING MEMORIAL

The current application claims a priority to the U.S. Provisional Patent application Ser. No. 61/746,721 filed on Dec. 28, 2012. The current application is filed on Dec. 30, 2013 while Dec. 28, 2013 was on a weekend.

FIELD OF THE INVENTION

The present invention relates generally to a wall mounted picture frame. More specifically, the present invention is a hanging memorial made for displaying a painting or photograph (physical or digital) of the deceased and for holding and displaying an urn. Furthermore, the hanging memorial provides storage space for inconspicuously retaining keepsakes of the deceased.

BACKGROUND OF THE INVENTION

Cremation is becoming an increasingly popular post-death rite as an alternative to a traditional burial. The process of cremation after death is appealing to individuals for many reasons. For example, some individuals would like their ashes to be spread at a location in which they had a strong connection to throughout their life, while others prefer cremation for environmental reasons, as burials can be source of environmental contaminants, mainly from the coffin. Many people who choose to be cremated will also allow their family or friends to decide what to do with the ashes after the cremation of the individual. In these instances, it is popular for the family or friends to store the ashes in an urn and create a memorial or shrine for the deceased individual. Such memorials or shrines often include a picture or pictures of the deceased individual and personal keepsakes of the deceased, in addition to the urn. This often leads to a clustered area of the house in which the objects of the memorial or shrine occupy.

Therefore it is the object of the present invention to provide a hanging memorial that has a frame and an integrated urn. The frame can be designed to show a single painting or photograph of the deceased, or the frame can be designed to show multiple pictures through the use of an electronic display screen. The urn can be supported by the frame in a number of ways and is prominently displayed, thus adding to the overall appearance of the hanging memorial. In addition to displaying a picture of the deceased and supporting the urn, the frame provides a storage volume in which keepsakes of the deceased can be placed.

DETAIL DESCRIPTIONS OF THE INVENTION

All illustrations of the drawings are for the purpose of describing selected versions of the present invention and are not intended to limit the scope of the present invention.

The present invention is a hanging memorial that is used to display a picture of a deceased individual, display the remains of the deceased individual, and store any keepsakes of the deceased. As such, the hanging memorial comprises a frame 1, an urn 3, and a storage volume 2. The urn 3 is integrated into the frame 1, such that the frame 1 prominently displays the urn 3, in addition to a painting or photograph of the deceased. The storage volume 2 is defined within the frame 1 and allows a mourn 3*er* to store keepsakes of the deceased out of sight, yet allows said keepsakes to be readily accessed for viewing.

Figure 1:
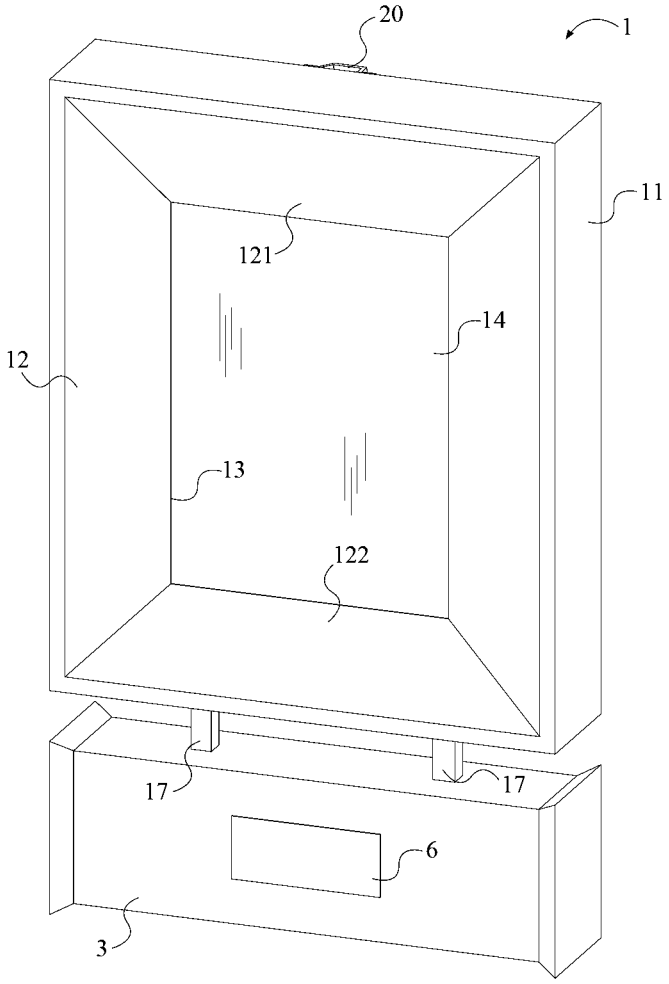
FIG. 1 is a perspective view of the urn being attached to the frame by the at least one bracket.

In reference to FIG. 1, the frame 1 comprises a lateral wall 11, a front panel 12, a frame opening 13, a frame insert 14, and a hanger 20. The frame opening 13 traverses through the front panel 12 creating the viewing space behind which the desired painting or photograph is placed. The lateral wall 11 is connected to the front panel 12 and is perimetrically positioned on the front panel 12 around the frame opening 13. Together, the front panel 12 and the lateral wall 11 form a housing in which keepsakes of the deceased can be stored. The frame insert 14 is positioned within the lateral wall 11, adjacent to the frame opening 13 and can be designed to hold and present a physical picture or can be designed to display multiple digital photographs.

The front panel 12 comprises a top portion 121 and a bottom portion 122; the top portion 121 being positioned opposite the bottom portion 122 about the frame opening 13. The top portion 121 defines the side of the frame 1 from which the present invention is hung, while the bottom portion 122 defines the side of the frame 1 that supports the urn 3.

The hanger 20 is positioned on the lateral wall 11 opposite the top portion 121 and allows the present invention to be hung from the desired surface. The hanger 20 may be selected from any suitable mechanism known in the art of hanging frame 1*s*, such as a D-ring, sawtooth hanger 20, triangular hanger 20, etc. Alternatively, the hanger 20 can be formed by drilling a hole or holes into the lateral wall 11 opposite the front panel 12. The frame 1 is then hung on the desired surface, such that nails or similar hanging protrusions extending from the surface are positioned within the hole(s) in order to support the present invention.

Figure 2:
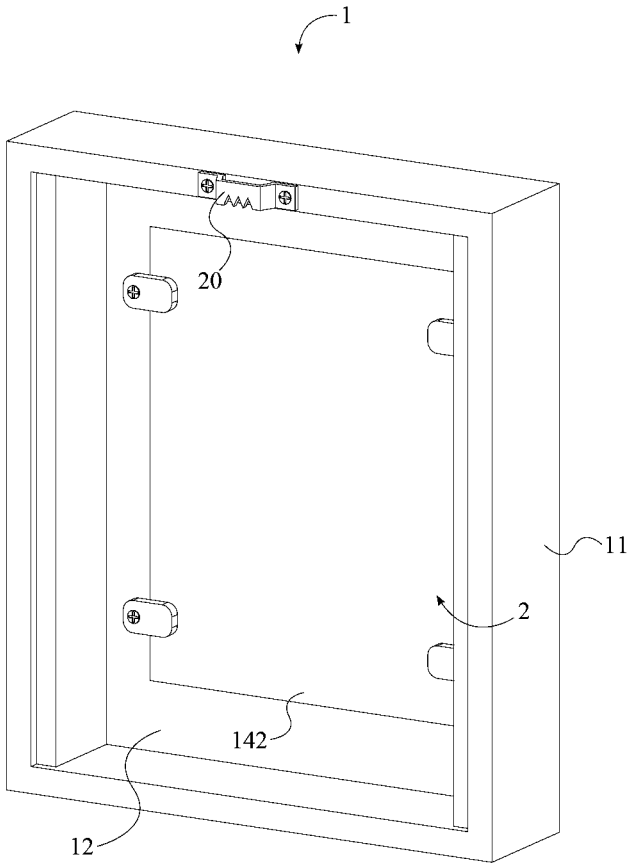
FIG. 2 is a perspective view showing the storage volume being defined by all sides of the lateral wall and the back panel being secured by a plurality of rotating fasteners.
Figure 3:
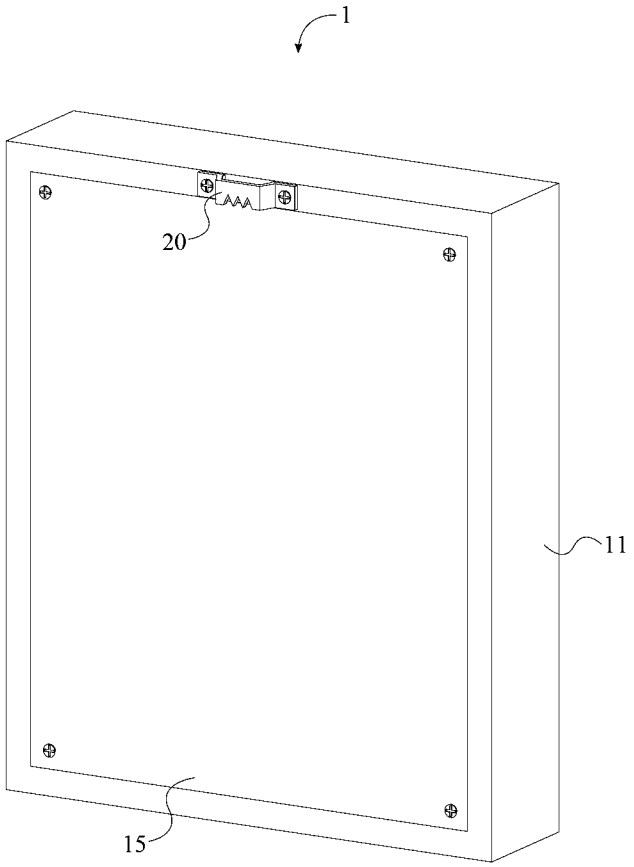
FIG. 3 is a perspective view showing the access panel attached to the lateral wall.
Figure 4:
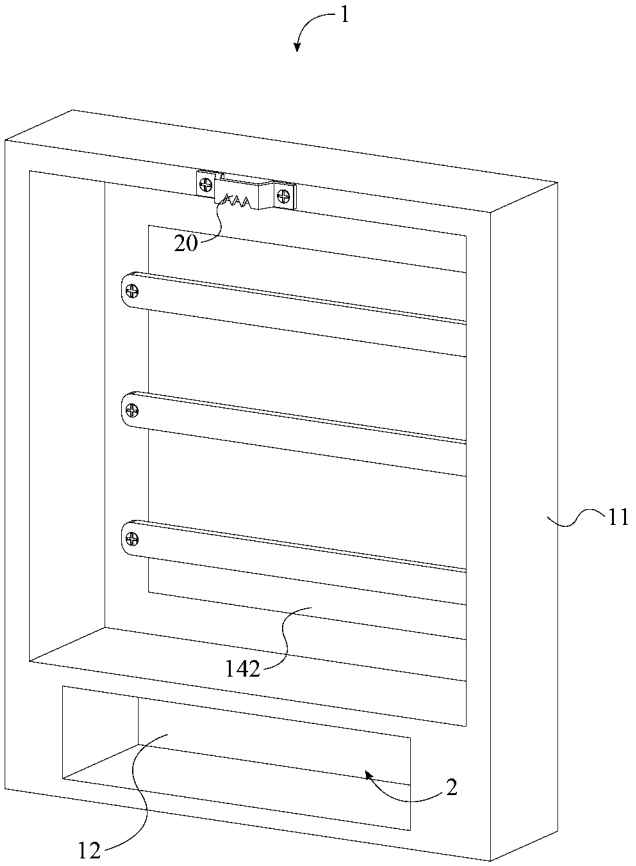
FIG. 4 is a perspective view showing the storage volume being defined by one side of the lateral wall and the back panel being secured by a plurality of cross members.
Figure 5:
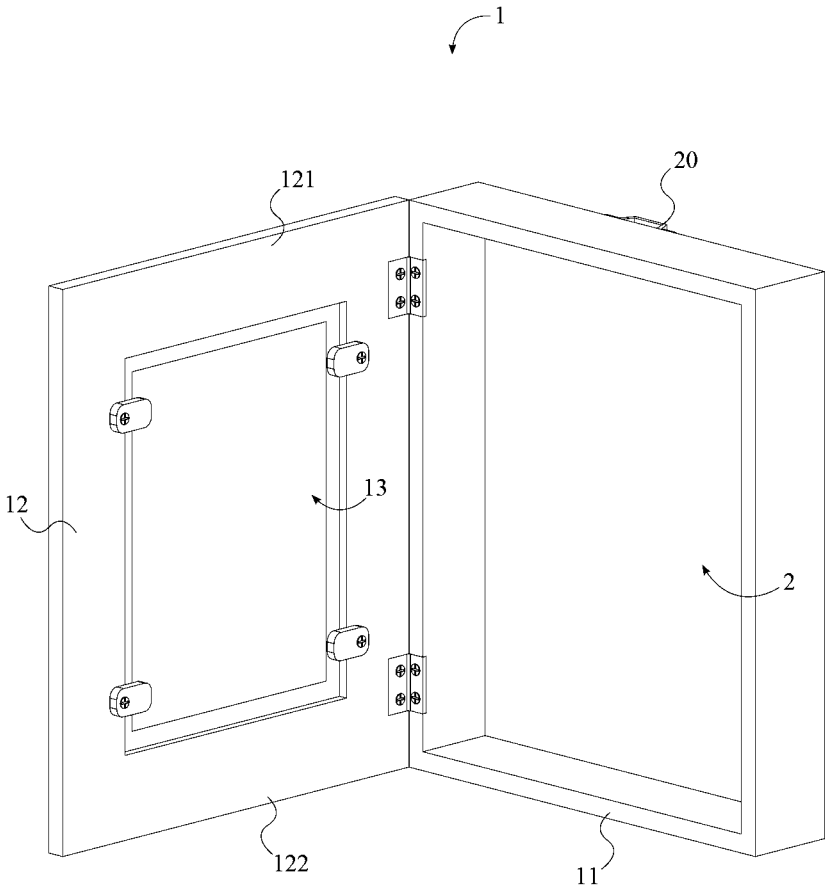
FIG. 5 is a perspective view showing the front panel being pivotally connected to the lateral wall.

In reference to FIG. 2-4, the lateral wall 11 and the front panel 12 delineate the storage volume 2. The storage volume 2 can be delineated by all sides of the lateral wall 11, as shown in FIG. 2, or by a single side of the lateral wall 11, such that the storage volume 2 traverses into only the one side, as shown in FIG. 4. The frame 1 further comprises an access panel 15; the access panel 15 being attached to the lateral wall 11 opposite the front panel 12. In this way, the access panel 15 secures the storage volume 2 closed. Preferably the access panel 15 is removably attached to the lateral wall 11 using screws, however, it is possible for any other method of attachment to be used, such as using rotating fasteners or a snap fit connection. In reference to FIG. 5, it is also possible for the front panel 12 to be pivotally connected to the lateral wall 11 using hinges, such that the access panel 15 secures the back of the frame 1 closed, while the storage volume 2 is made accessible to the user by opening the front panel 12.

Figure 6:
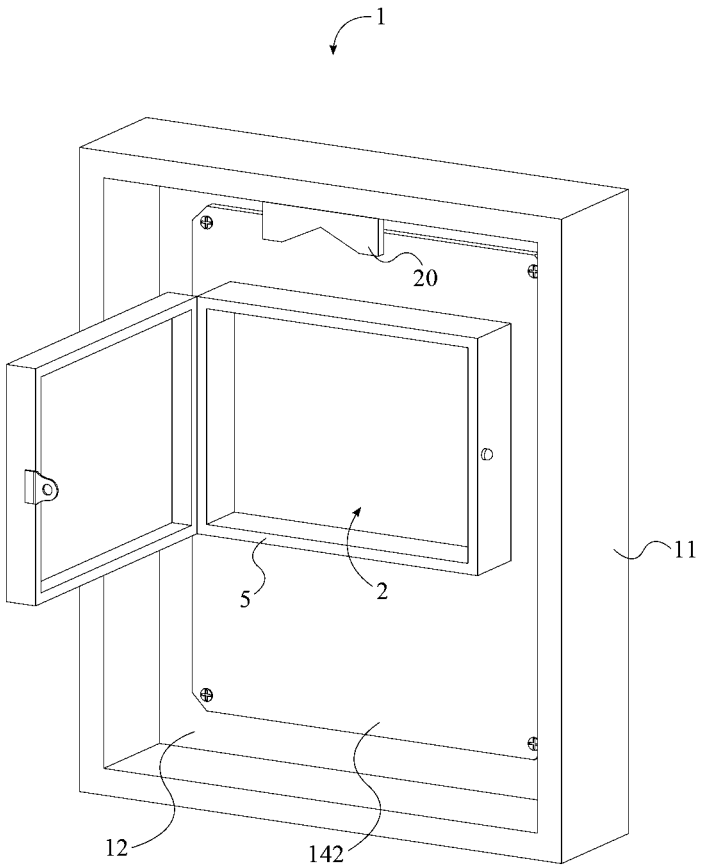
FIG. 6 is a perspective view showing the storage volume being defined by a storage box.

Alternatively, the hanging memorial may further comprise a storage box 5, wherein the storage box 5 delineates the storage volume 2, as shown in FIG. 6. The storage box 5 is positioned within the lateral wall 11 and connected to the frame insert 14. It is also possible for the storage box 5 to be connected to the lateral wall 11. As no access panel 15 is needed, the back of the frame 1 remains open, providing quick access to the storage box 5 and the frame insert 14. The storage box 5 can be of any shape and design. Access to the storage volume 2 within the storage box 5 can be provided through a hinged or otherwise fully or partially detachable lid. A locking mechanism for the lid may also be included in order to securely store keepsakes within the storage box 5.

Figure 7:
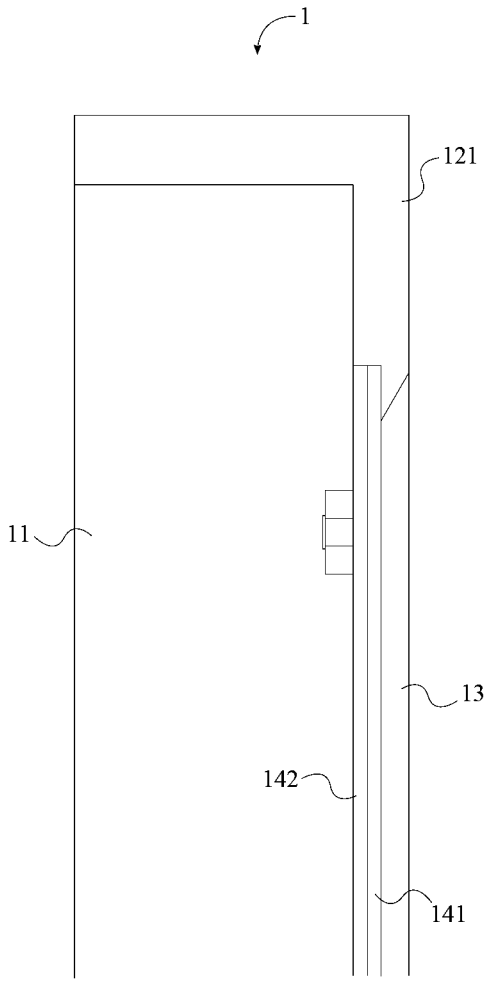
FIG. 7 is a left side sectional view showing the frame insert positioned adjacent to the frame opening.

In reference to FIG. 7, when a physical picture is desired, the frame insert 14 comprises a transparent panel 141 and a back panel 142. The back panel 142 is removably attached to the front panel 12, with the transparent panel 141 being positioned in between the front panel 12 and the back panel 142. The transparent panel 141 rests within a shallow recess cut into the back of the front panel 12 around the frame opening 13 and is held in place by the back panel 142. Depending on the desired method for attaching the back panel 142, the back panel 142 may also be positioned within the recess in the back of the front panel 12. The desired painting or photograph is positioned in between the transparent panel 141 and the back panel 142, such that the painting or photograph can be viewed through the frame opening 13 and the transparent panel 141. The transparent panel 141 can be constructed from glass, plastic, acrylic, or any other suitable material.

The back panel 142 can be attached to the front panel 12 in a number of ways, such that the back panel 142 is readily detachable from the front panel 12 in order to insert or replace the desired painting or photograph. In one embodiment of the present invention, the back panel 142 is simply screwed onto the front panel 12, as shown in FIG. 6. In another embodiment of the present invention, the frame 1 further comprises a plurality of rotating fasteners, as shown in FIG. 2. Each of the plurality of rotating fasteners is positioned around the frame opening 13 and pivotally connected to the front panel 12 within the lateral wall 11. The back panel 142 is positioned over the frame opening 13, within the back recess of the front panel 12, such that the back panel 142 rests flush with the front panel 12. Each of the plurality of rotating fasteners is then positioned overtop the back panel 142, thus bracing the back panel 142 in between the front panel 12 and the plurality of rotating fasteners. In yet another embodiment of the present invention, a plurality of cross members are positioned overtop of the back panel 142, as shown in FIG. 4. Both ends of each of the plurality of cross members is then attached to the front panel 12 using screws. In addition to the methods of attachment described above, it is possible for the back panel 142 to be removably attached to the front panel 12 in any other way.

Figure 8:
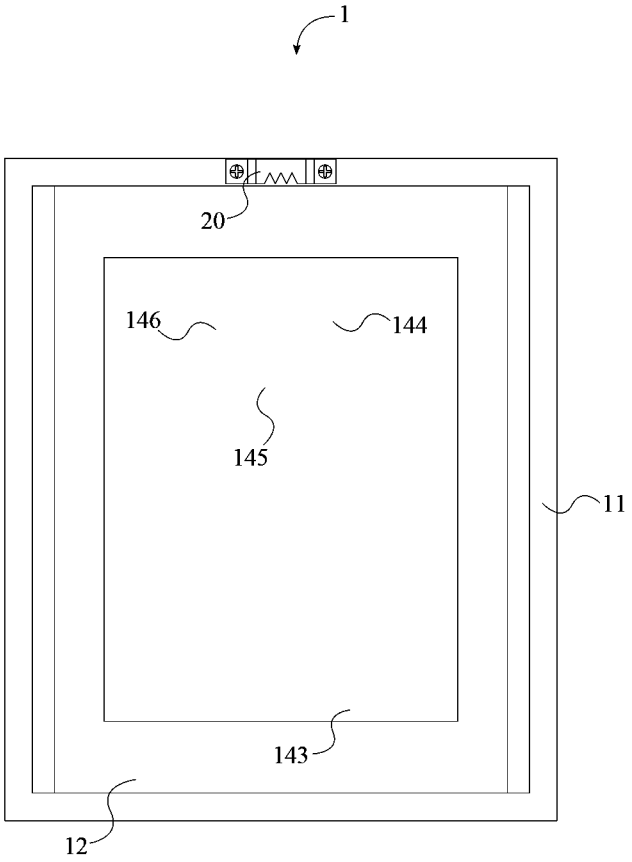
FIG. 8 is a rear elevational view showing the frame insert being a digital display.
Figure 9:
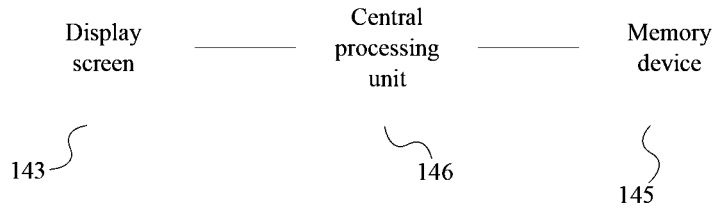
FIG. 9 is a diagram depicting the electronic connections thereof.
Figure 10:
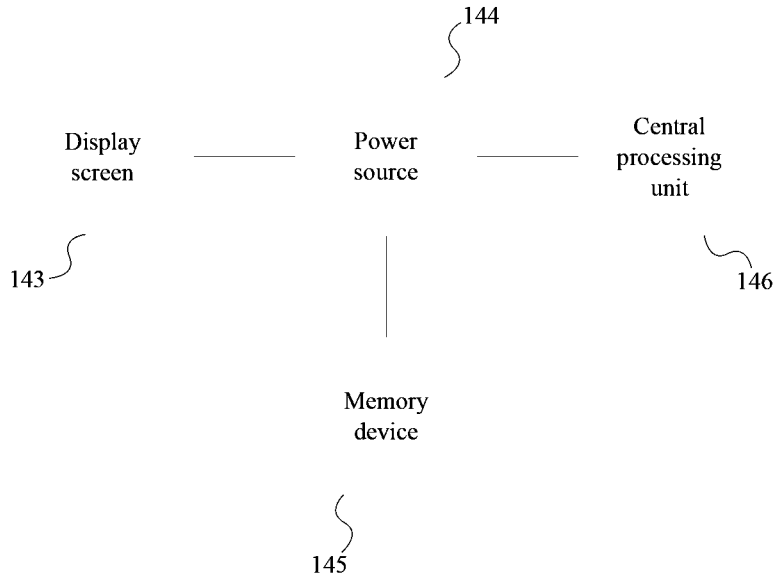
FIG. 10 is a diagram depicting the electrical connection thereof.

In reference to FIG. 8, the present invention may alternatively support pictures of the digital variety. In such a case, the frame insert 14 comprises a display screen 143, a power source 144, a memory device 145, and a central processing unit 146. The display screen 143 is positioned adjacent to the frame opening 13 and is connected to the front panel 12, as shown in FIG., and projects the desired images to viewers. The memory device 145 is used to store the digital image files, as well as display settings, an operating system, or any other digital data necessary for operating the frame insert 14. The central processing unit 146 is used to process commands stored on the memory device 145 and select image files to be displayed on the display screen 143. As such, both the memory device 145 and the display screen 143 are electronically connected to the central processing unit 146, as depicted in FIG. 9. The central processing unit 146 may be configured to display a single image or multiple images in slideshow. The central processing unit 146 may also have to capacity to store digital data. The power source 144 provides electrical current to power the display screen 143, the memory device 145, and the central processing unit 146, and as such is electrically connected to the display screen 143, the memory device 145, and the central processing unit 146, as depicted in FIG. 10. The power source 144 can be of the portable variety, such as a battery, or of the fixed variety, such as a power connection to an electrical outlet. Any well known battery technology can be used such as lithium ion or nickel cadmium technology if a battery is desired.

The frame insert 14 further comprises a data port or a transceiver in order to transfer digital image files to the memory device 145. If the data port is used, then the data port may be accessible within the lateral wall 11 behind the front panel 12, or the data port may traverse through either the lateral wall 11 or front panel 12, such that it can be externally accessed by an individual. The transceiver allows data to be transferred to and from the memory device 145 wirelessly, and as such, if the transceiver is used, the transceiver is positioned within the lateral wall 11 behind the front panel 12. In either instance, the data port or the transceiver is electrically connected to the power source 144 and electronically connected to the central processing unit 146. It is also possible for the data port and the transceiver to be used in conjunction with one another. One or more display controls can also be provided in order to control the frame insert 14, such as adjusting the display screen 143 brightness, the speed at which images are displayed in a slideshow, etc. The display controls can be positioned out of the lateral wall 11 or front panel 12, such that they are externally accessible to the user or positioned within the lateral wall 11 behind the front panel 12 to avoid tampering with.

Figure 11:
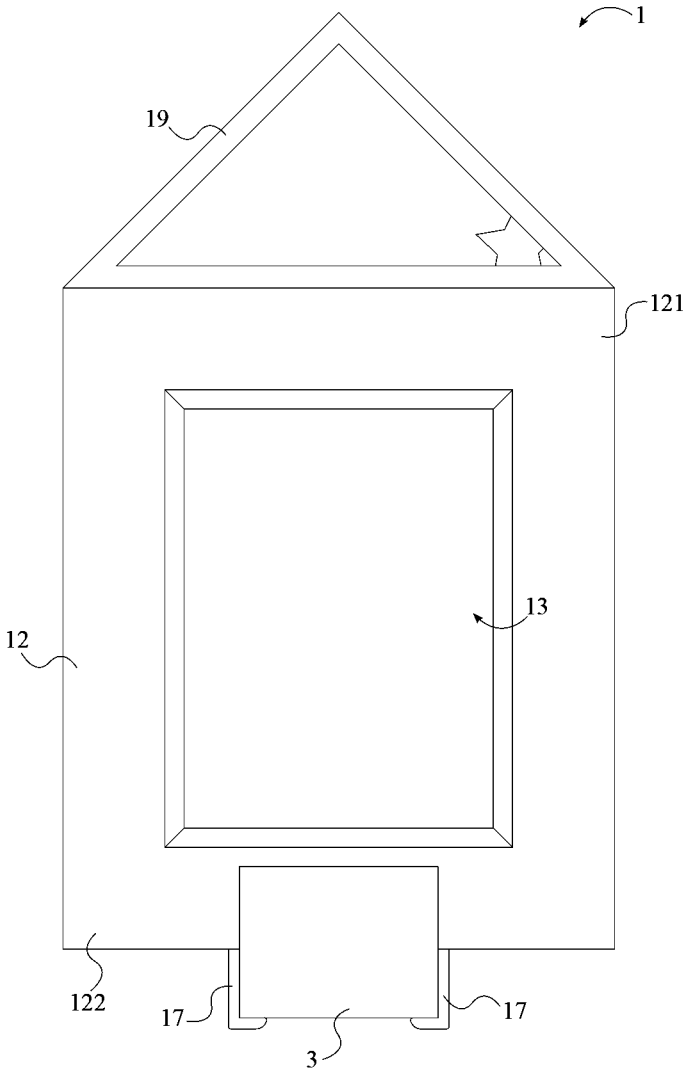
FIG. 11 is a front elevational view showing the frame having a flag holder.

In reference to FIG. 11, the frame 1 may further comprise a flag holder 19. The flag holder 19 is adjacently connected to the lateral wall 11 and is a triangular shaped frame 1 such that a folded flag can be placed inside. A piece of glass or other transparent material may also be positioned about the front of the flag holder 19 to protect and secure the flag while maintaining the visibility of the flag. The flag holder 19 is particularly suited to honoring fallen servicemen, allowing the folded national flag to be displayed as a sign of respect and admiration.

The urn 3 may be constructed in a variety of designs, such as a vase or box style, and as such the frame 1 provides multiple supporting means for attaching the urn 3 in the desired design to the frame 1. In some embodiments of the present invention the frame 1 further comprises an at least one bracket 17. In reference to FIG. 1, the at least one bracket 17 is positioned along the lateral wall 11 adjacent to the bottom portion 122 of the front panel 12, and the urn 3 is connected to the at least one bracket 17 opposite the lateral wall 11. The at least one bracket 17 can be connected to any side of the urn 3. Preferably the lid of the urn 3 is connected to the at least one bracket 17; the body of the urn 3 being detachable from the lid of the urn 3. In one embodiment of the present invention, the at least one bracket 17 is removably attached to the lateral wall 11, wherein the means of attachment, such as a nut and bolt connection, are accessible within the storage volume 2. Once the at least one bracket 17 has been detached from the lateral wall 11, the lid of the urn 3 can then be removed in order to access the interior of the urn 3.

Figure 12:
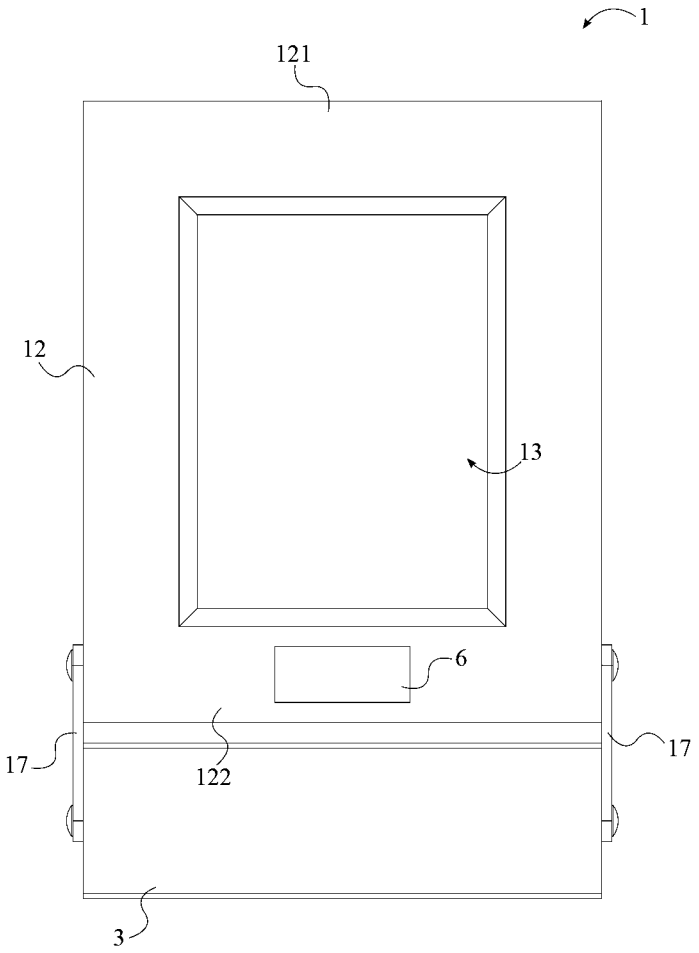
FIG. 12 is a front elevational view showing the urn being pivotally connected to the frame by two brackets.
Figure 13:
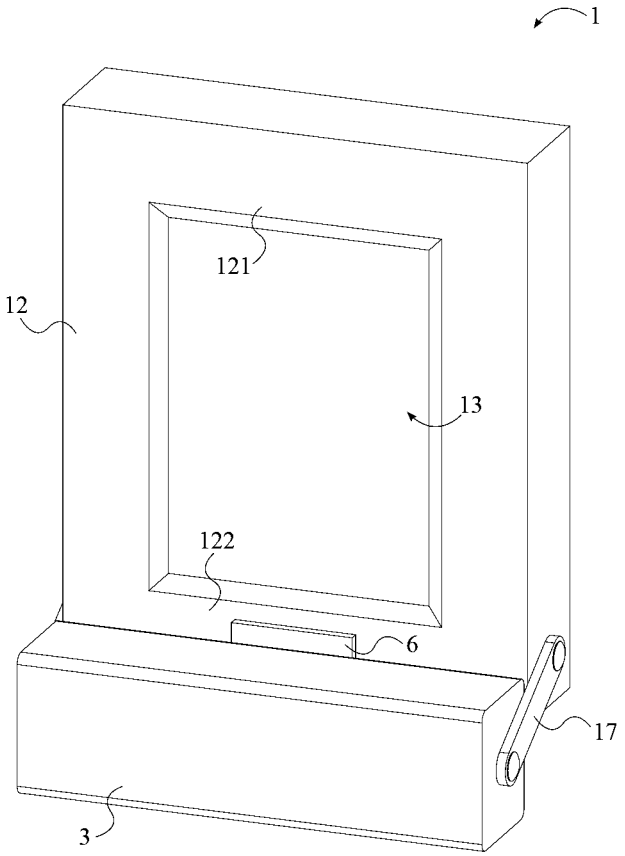
FIG. 13 is a perspective view thereof showing the urn being pivoted upwards.

In another embodiment of the present invention, the at least one bracket 17 is specifically two brackets, as shown in FIG. 12-13. Each of the at least one bracket 17 is pivotally connected to both the lateral wall 11 and the urn 3, and arranged such that the lateral wall 11 and the urn 3 are positioned in between each of the at least one bracket 17. In this way, the urn 3 normally rests below the frame 1, but can be pivoted up and away from the frame 1 in order to access the lid of the urn 3, and thus the inner volume of the urn 3.

In multiple embodiments of the present invention, the hanging memorial further comprises a niche 4. The niche 4 traverses through the front panel 12 into the lateral wall 11 creating a region of open space in the frame 1. The niche 4 is centrally positioned along the bottom portion 122 of the front panel 12 as to maintain symmetry throughout the present invention, as this is generally more aesthetically pleasing to viewers. The urn 3 is positioned into the niche 4 and can be supported by the frame 1 in a number of ways.

Figure 14:
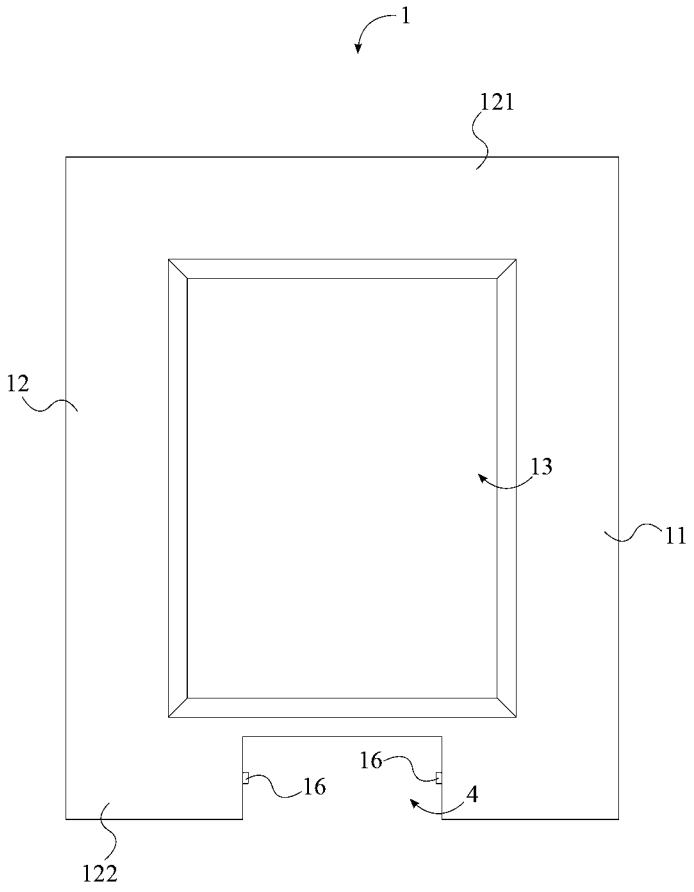
FIG. 14 is a front elevational view showing the frame having a pair of track members positioned within the niche.
Figure 15:
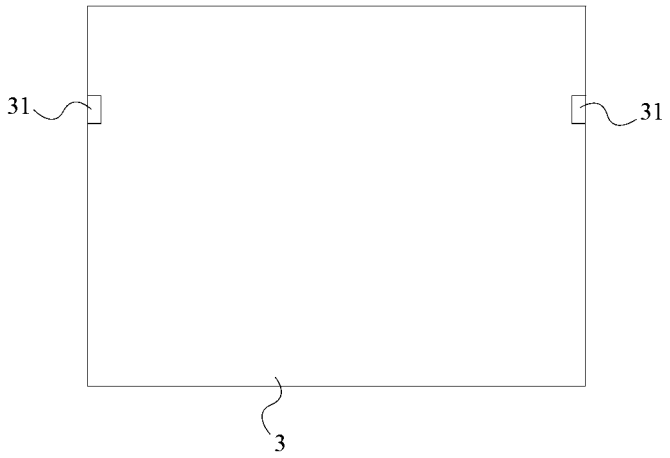
FIG. 15 is a rear elevational view of the urn having a pair of opposing track members.
Figure 16:
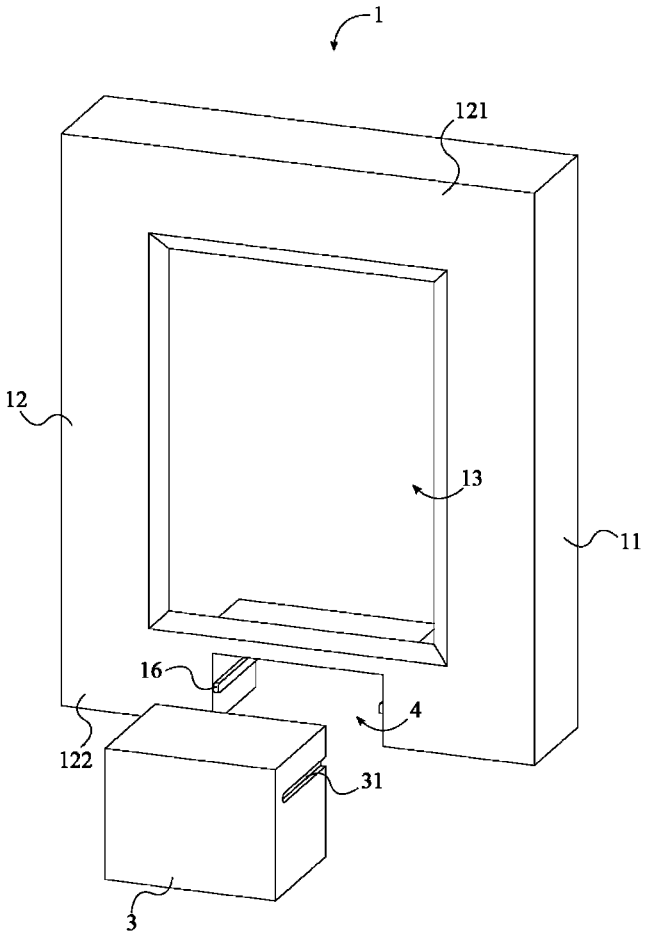
FIG. 16 is a perspective view showing the pair of opposing track members being aligned with the pair of track members in order to engage the pair of track members.

In one embodiment of the present invention that comprises the niche 4, the frame 1 further comprises a pair of track members 16; the pair of track members 16 being positioned on the front panel 12 and the lateral wall 11, and being positioned opposite each other about the niche 4, as shown in FIG. 14. Additionally, the urn 3 comprises a pair of opposing track members 31; the opposing pair of track members 16 being positioned opposite each other about the urn 3, as shown in FIG. 15. In order to secure the urn 3 within the niche 4, the pair of opposing track members 31 is first aligned with the pair of track members 16, as shown in FIG. 16. As the urn 3 is positioned into the niche 4, the pair of track members 16 then engages the pair of opposing track members 31, thus securely retaining the urn 3 within the niche 4. Preferably the pair of track members 16 is formed by extrusions of the front panel 12 and the lateral wall 11 into the niche 4, and the pair of opposing track members 31 is formed by creating indented strips along the urn 3. However, the configurations can also be switched; the pair of track members 16 being indentations and the pair of opposing track members 31 being extrusions. It is also possible for the pair of track members 16 and the pair of opposing track members 31 to be formed in any other manner, such as being separately formed components connected to the frame 1 and urn 3, respectively, much like the track components of sliding drawers. Furthermore, the pair of track members 16 or the pair of opposing track members 31 may comprise a track lock to prevent the urn 3 from fully detaching from the frame 1.

In other embodiments of the present invention, the at least one bracket 17 is used in conjunction with the niche 4. The at least one bracket 17 is connected to the lateral wall 11 and is positioned adjacent to the niche 4. Preferably, the at least one bracket 17 is connected to the lateral wall 11 by a pair of screws, however, it is possible for the at least one bracket 17 to be connected to the lateral wall 11 in any other way. The at least one bracket 17 provides a support along the bottom of the niche 4, such that when the urn 3 is positioned within the niche 4, the urn 3 is positioned on the at least one bracket 17. The at least one bracket 17 can be positioned along one or more sides of the niche 4. Use of the at least one bracket 17 is conducive to the use of the urn 3 being either of the vase or box variety.

Figure 17:
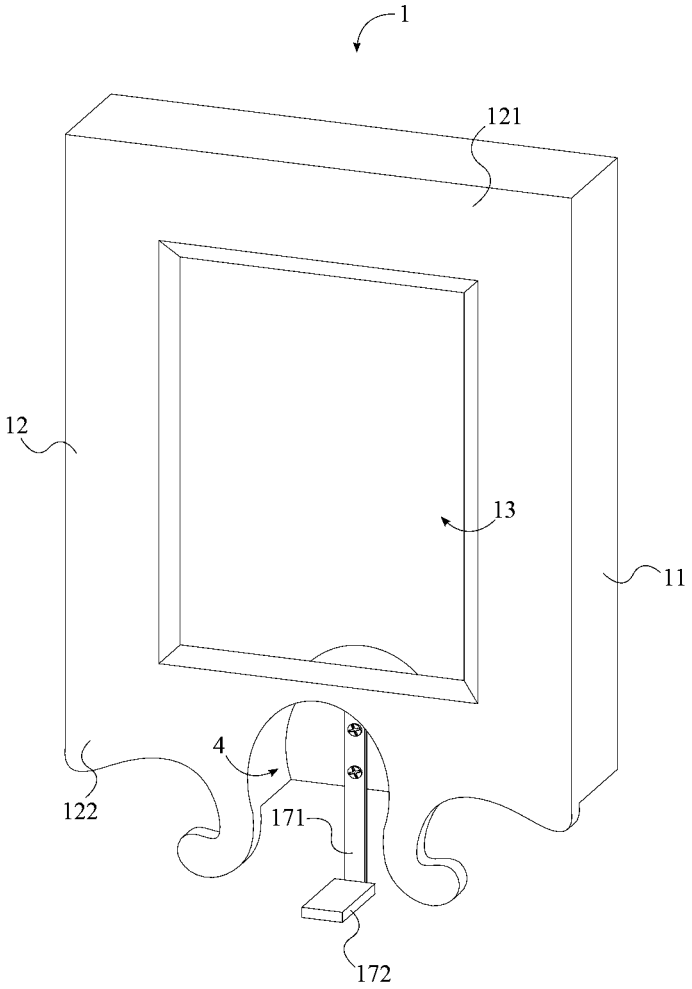
FIG. 17 is a perspective view showing one bracket being centrally positioned with the niche.
Figure 18:
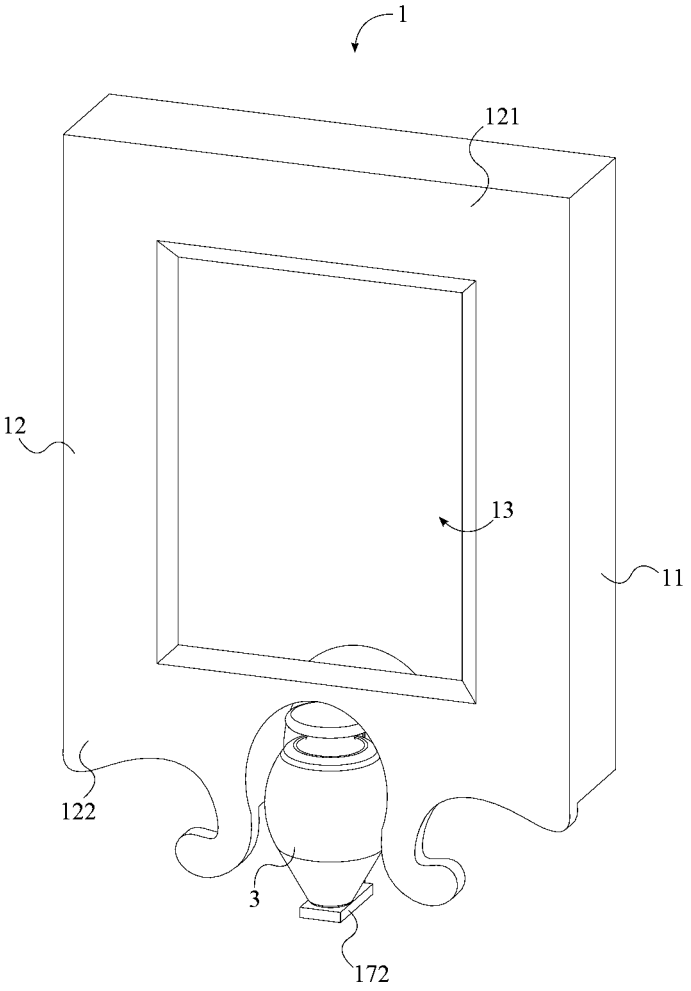
FIG. 18 is a perspective view thereof with the urn positioned into the niche.
Figure 19:
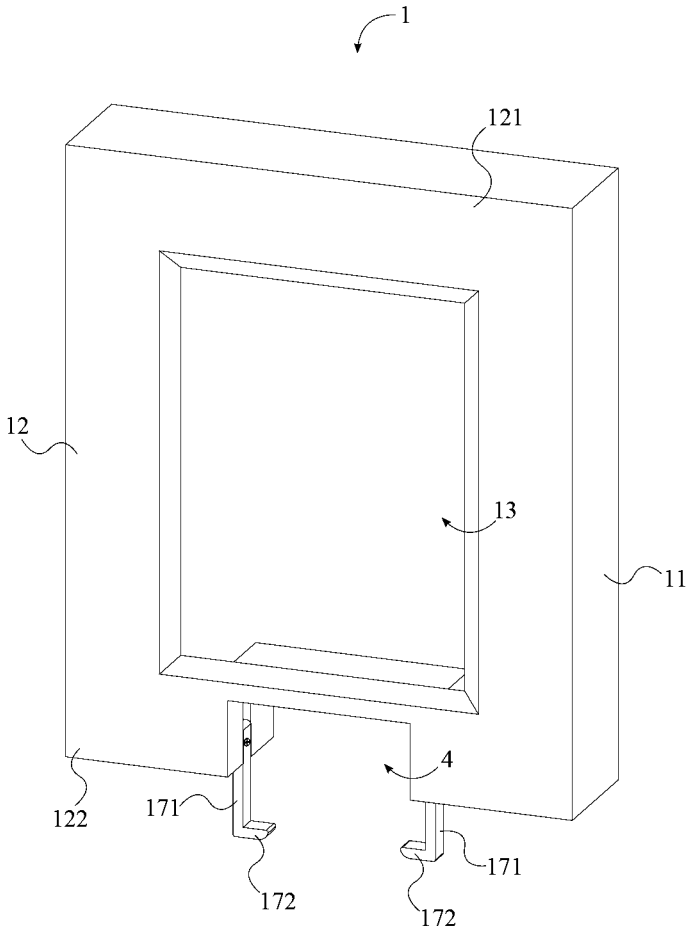
FIG. 19 is a perspective view showing two brackets being positioned opposite each other about the niche.
Figure 20:
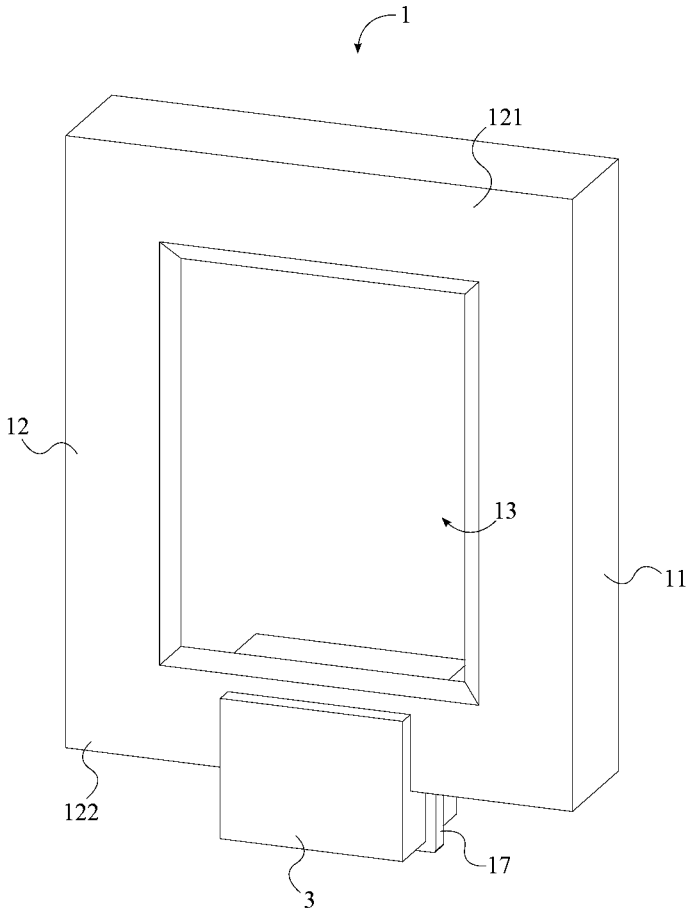
FIG. 20 is a perspective view thereof with the urn positioned into the niche.

When used in conjunction with the niche 4, the at least one bracket 17 comprises a vertical member 171 and a horizontal member 172. The vertical member 171 is connected to the lateral wall 11, while the horizontal member 172 is perpendicularly connected to the vertical member 171 opposite the lateral wall 11. The urn 3 is then positioned on the horizontal member 172, which in turn 3 supports the urn 3, while the sides of the urn 3 are braced by the vertical member 171, the lateral wall 11, and the front panel 12. If the urn 3 is of the vase variety, then the at least one bracket 17 is specifically one bracket that is positioned centrally with the niche 4, as shown in FIG. 17-18. If the urn 3 is of the box variety, then the at least one bracket 17 is specifically two brackets positioned opposite of each other about the niche 4, as shown in FIG. 19-20.

Figure 21:
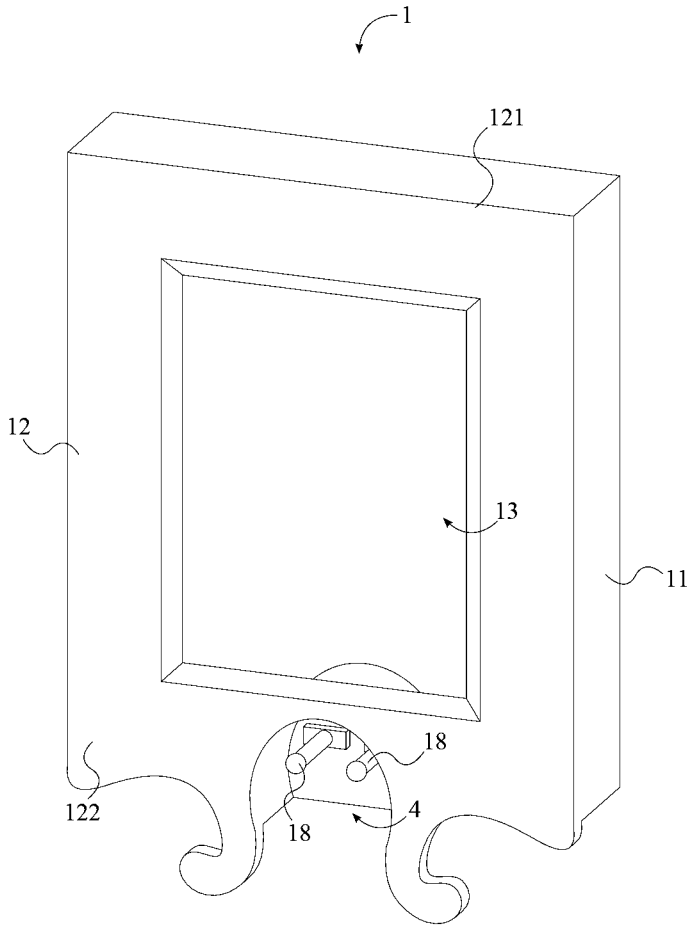
FIG. 21 is a perspective view showing a pair of horizontal prongs being positioned within the niche.
Figure 22:
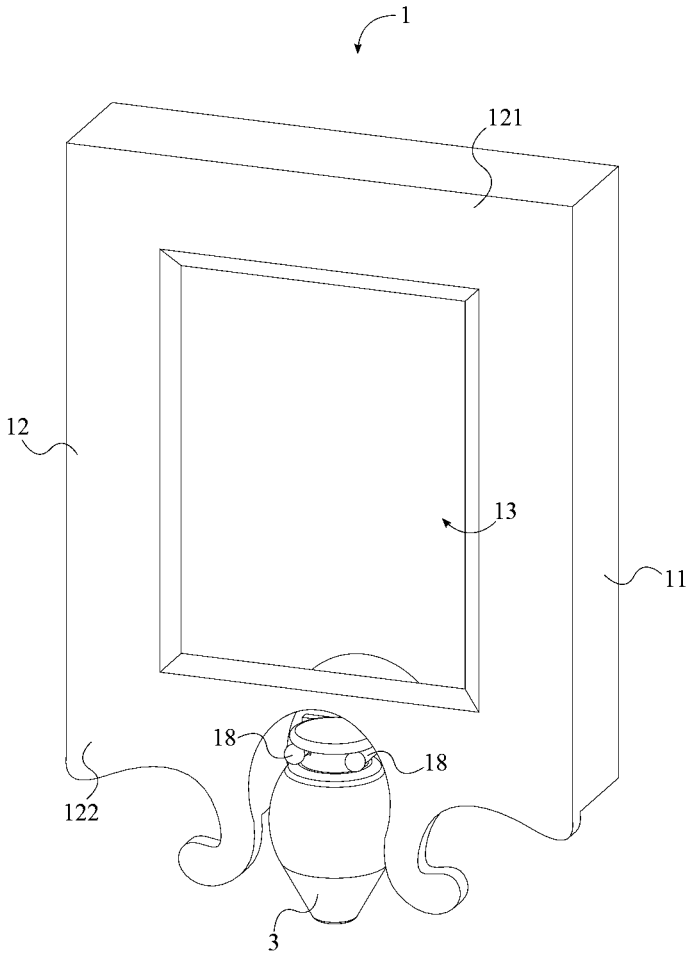
FIG. 22 is a perspective view thereof with the urn being supported by the pair of horizontal prongs.

In yet another embodiment of the present invention featuring the niche 4, the frame 1 further comprises a pair of horizontal prongs 18, as shown in FIG. 21. The pair of horizontal prongs 18 is connected to the lateral wall 11 and positioned within the niche 4. Preferably, each of the pair of horizontal prongs 18 is connected to the lateral wall 11 by a pair of screws, however, it is possible for the pair of horizontal prongs 18 to be connected to the lateral wall 11 in any other way. The urn 3, being of the vase variety, is slid into position in between each of the pair of horizontal prongs 18, wherein the pair of prongs supports the urn 3 around a neck portion of the urn 3, as shown in FIG. 22.

In reference to FIG. 1, the present invention may also include a commemorative plaque 6. The commemorative plaque 6 allows individuals of the deceased to create personalized inscriptions, such as the name of the deceased, an obituary, date of birth and death, etc. The commemorative plaque 6 can be connected to either the front panel 12 or the urn 3. If the commemorative plaque 6 is connected to the front panel 12, then the commemorative plaque 6 is positioned on the front panel 12 opposite the lateral wall 11, such that the commemorative plaque 6 is visible to viewers. If the commemorative plaque 6 is connected to the urn 3, then the commemorative plaque 6 is positioned on the front facing surface of the urn 3, such that the commemorative plaque 6 is visible to viewers.

Although the invention has been explained in relation to its preferred embodiment, it is to be understood that many other possible modifications and variations can be made without departing from the spirit and scope of the invention as hereinafter claimed.

What is claimed is:

1. A hanging memorial comprises:

a frame;

a storage volume;
an urn;
the frame comprises a lateral wall, a front panel, a frame opening, and a frame insert;
the front panel comprises a top portion and a bottom portion;
the frame opening traversing through the front panel;
the top portion being positioned opposite the bottom portion about the frame opening;
the lateral wall being perimetrically positioned on the front panel around the frame opening;
the lateral wall being connected to the front panel;
the frame insert being positioned within the lateral wall;
the frame insert being positioned adjacent to the frame opening, wherein the frame insert fully obstructs the frame opening;
the storage volume being bounded within the lateral wall;
the urn being integrated into the frame;
a niche;
the niche traversing through the front panel and into the lateral wall; and
the urn being positioned into the niche.

2. The hanging memorial as claimed in claim 1 comprises:
the front panel being pivotally connected to the lateral wall.

3. The hanging memorial as claimed in claim 1 comprises:
the frame further comprises an access panel;
the access panel being attached to the lateral wall opposite the front panel; and
the lateral wall and the front panel delineating the storage volume.

4. The hanging memorial as claimed in claim 1 comprises:
a storage box;
the storage box being positioned within the lateral wall;
the storage box being connected to the frame insert; and
the storage box delineating the storage volume.

5. The hanging memorial as claimed in claim 1 comprises:
the frame further comprises a pair of track members;
the urn comprises a pair of opposing track members;
the pair of track members being positioned on the front panel and the lateral wall;
the pair of opposing track members being positioned opposite each other about the niche;
the pair of track members being positioned opposite each other about the urn; and
the pair of opposing track members engaging the pair of track members, wherein the urn is attached to the frame.

6. The hanging memorial as claimed in claim 1 comprises:
the frame further comprises an at least one bracket;
the at least one bracket being connected to the lateral wall;
the at least one bracket being positioned adjacent to the niche; and
the urn being positioned on the at least one bracket.

7. The hanging memorial as claimed in claim 6 comprises:
each of the at least one bracket comprises a vertical member and a horizontal member;
the vertical member being connected to the lateral wall;
the horizontal member being perpendicularly connected to the vertical member opposite the lateral wall; and
the urn being positioned on the horizontal member of each of the at least one bracket.

8. The hanging memorial as claimed in claim 7, wherein the at least one bracket is specifically one bracket centrally positioned with the niche.

9. The hanging memorial as claimed in claim 7, wherein the at least one bracket is specifically two brackets positioned opposite each other about the niche.

10. The hanging memorial as claimed in claim 1 comprises:
the frame further comprises a pair of horizontal prongs;
the pair of horizontal prongs being connected to the lateral wall;
the pair of horizontal prongs being positioned within the niche; and
the urn being positioned in between each of the pair of horizontal prongs, wherein the pair of prongs supports the urn.

11. The hanging memorial as claimed in claim 1 comprises:
the niche being centrally positioned along the bottom portion.

12. The hanging memorial as claimed in claim 1 comprises:
the frame further comprises an at least one bracket;
the at least one bracket being positioned on the lateral wall adjacent to the bottom portion; and
the urn being connected to the at least one bracket opposite the lateral wall.

13. The hanging memorial as claimed in claim 12 comprises:
the at least one bracket being two struts;
each of the at least one bracket being pivotally connected to the lateral wall;
each of the at least one bracket being pivotally connected to the urn; and
the lateral wall and the urn being positioned in between each of the at least one bracket.

14. The hanging memorial as claimed in claim 1 comprises:
a commemorative plaque;
the commemorative plaque being connected to the front panel; and
the commemorative plaque being positioned on the front panel opposite the lateral wall.

15. The hanging memorial as claimed in claim 1 comprises:
a commemorative plaque; and
the commemorative plaque being connected to the urn.

16. The hanging memorial as claimed in claim 1 comprises:
the frame insert comprises a transparent panel and a back panel;
the back panel being attached to the front panel; and
the transparent panel being positioned in between the front panel and the back panel, wherein the transparent panel is held in place by the back panel.

17. The hanging memorial as claimed in claim 1 comprises:
the frame insert comprises a display screen, a power source, a memory device, and a central processing unit;
the display screen being positioned adjacent to the frame opening;
the display screen being connected to the front panel;
the display screen, the memory device, and the central processing unit being electrically connected to the power source; and
the display screen and the memory device being electronically connected to the central processing unit.

18. The hanging memorial as claimed in claim 1 comprises:
the frame further comprises a flag holder; and
the flag holder being adjacently connected to the lateral wall.

19. The hanging memorial as claimed in claim 1 comprises:

the frame further comprises a hanger; and the hanger being positioned on the lateral wall opposite the top portion.

* * * * *